US006603133B2

(12) United States Patent
Peters et al.

(10) Patent No.: US 6,603,133 B2
(45) Date of Patent: Aug. 5, 2003

(54) END SUPPORT SYSTEM FOR A SHIPPING CONTAINER FOR NUCLEAR FUEL

(75) Inventors: William Carter Peters, Wilmington, NC (US); Roger Evan Strine, Wilmington, NC (US)

(73) Assignee: Global Nuclear Fuel -- Americas LLC, Wilmington, NC (US)

( * ) Notice: Subject to any disclaimer, the term of this patent is extended or adjusted under 35 U.S.C. 154(b) by 264 days.

(21) Appl. No.: 09/726,390

(22) Filed: Dec. 1, 2000

(65) Prior Publication Data

US 2002/0067791 A1 Jun. 6, 2002

(51) Int. Cl.[7] ..... G21F 5/00; G21F 1/00; G21F 3/04

(52) U.S. Cl. ..... 250/506.1; 250/517.1

(58) Field of Search ..... 250/517.1, 506.1, 250/505.1; 211/103; 312/265.1; 219/528; 256/19; 376/272

(56) References Cited

U.S. PATENT DOCUMENTS

| | | | | |
|---|---|---|---|---|
| 1,688,437 A | | 10/1928 | Romine | |
| 2,008,605 A | | 7/1935 | Woodruff | |
| 2,920,781 A | | 1/1960 | Butcher et al. | |
| 4,803,042 A | * | 2/1989 | Gilmore et al. | 376/272 |
| 5,228,762 A | * | 7/1993 | Mascrier | 312/265.1 |
| 5,417,516 A | * | 5/1995 | Birtchet | 219/528 |
| 5,709,359 A | * | 1/1998 | Riley | 211/103 |
| 5,862,642 A | * | 1/1999 | Erwin | 256/19 |

FOREIGN PATENT DOCUMENTS

| | | |
|---|---|---|
| DE | 37 16 913 A | 12/1988 |

* cited by examiner

*Primary Examiner*—John R. Lee
*Assistant Examiner*—Paul M. Gurzo
(74) *Attorney, Agent, or Firm*—Nixon & Vanderhye

(57) ABSTRACT

An end support system is applied to each end of a container for shipping nuclear fuel assemblies in an inner box within the container. The end support system includes a rectilinear metal end frame, a crosspiece with a reinforcing channel along an inside surface of the crosspiece and four arms projecting in a perpendicular direction from the metal end frame for straddling the sides of the container end. By screwing the metal end support system into the wooden framing elements of the container, the integrity of the container ends is maintained during hypothetical accident conditions specified in licensing regulations.

16 Claims, 4 Drawing Sheets

END SUPPORT SYSTEM FOR A SHIPPING CONTAINER FOR NUCLEAR FUEL

BACKGROUND OF THE INVENTION

The present invention relates to a container for shipping nuclear fuel assemblies and particularly relates to an end support system for the outer wooden container for the nuclear fuel assemblies.

Containers are conventionally used to ship nuclear fuel assemblies. Typically, each container includes an inner metal box with two separate channels, each of which carries a single nuclear fuel assembly. Normally, a pair of such nuclear fuel assemblies are arranged in side-by-side relation within the inner metal box. The inner box with the fuel assemblies is typically packaged for shipment within an outer container formed of wooden framing elements, panels interconnecting the framing elements and fillers to prevent movement of the inner box relative to the outer container. The outer container is sealed with metal bolts and is also banded with metal straps.

It has become significant for meeting both domestic and international licensing requirements that the integrity of the outer container not be compromised as a result of certain drop and fire tests required by various licensing agencies. For example, licensing regulations require 4-foot and 30-foot drop tests in which the inner metal box must be completely contained within the wooden outer container during the drop tests. Recent drop tests have demonstrated failure of certain prior outer wooden containers to meet the requirements of these drop tests. Specifically, the inner metal box must not break out of or breach the outer wooden container during the drop tests. In preliminary tests, however, it has been observed that the ends of the wooden outer container do break out and no longer provide containment for the inner metal box actually containing the nuclear fuel assemblies. The wooden end frames at the ends of the wooden outer container appear particularly vulnerable to damage and, in certain cases, have broken away from the wooden container, exposing the inner metal box. Accordingly, there is a need for end support systems for nuclear fuel shipping containers which can absorb energy during the drop tests and contain damage to the container ends such that the shipping containers comply with various regulatory licensing requirements.

BRIEF SUMMARY OF THE INVENTION

In accordance with a preferred embodiment of the present invention, there is provided an end support system for a nuclear fuel assembly shipping container which sufficiently maintains the integrity of the wooden container ends to meet the requirements of licensing regulations. To accomplish the foregoing, each end support system includes a metal end frame for overlying the wooden framing elements forming the ends of the wooden shipping container. It will be appreciated that the ends of the wooden container comprise rectilinear end frames formed of wooden framing elements, typically 2×4s, each having a panel secured to the inside surface of the end frame. The end panels are conventionally formed of plywood. The wooden end frame is secured to longitudinally extending wooden structural framing elements formed along the sides, top and bottom of the container. Each end support system hereof includes a metal end frame formed of top, bottom and side metal plates secured to one another forming a rectilinear frame. A metal cross-piece extends between opposed plates, e.g., the side plates, and carries a reinforcing member engageable with the end panel of the container to reinforce the panel. Additionally, opposite ends of the reinforcing member engage the edges of the wooden framing members at opposite sides of the wooden end frames. With each metal end frame overlying the wooden end framing elements and secured thereto, for example, by a plurality of metal screws, the wooden end frame is substantially reinforced.

Additionally, at least four arms formed of metal plates are secured to the metal end frame. The arms extend in a perpendicular direction from the metal end frame for overlying opposite sides of the container along the longitudinally extending wooden structural framing elements. The arms, like the end frame, are secured to the wooden framing elements, for example, by a plurality of metal screws. The metal end frame and lateral support arms thus constitute an end support system for each of the opposite ends of the wooden container. Each end support system reinforces a container end ensuring its integrity and prevents breach of the container end sufficiently to comply with licensing regulations.

In a preferred embodiment according to the present invention, there is provided an end support system for a container for shipping nuclear fuel, comprising first and second elongated metal plates generally parallel to and spaced from one another and third and fourth metal plates generally parallel to and spaced from one another, the third plate being secured at opposite ends to ends of the first and second plates and the fourth plate being secured at opposite ends to opposite ends of the first and second plates thereby forming a generally rectilinear metal end frame, an elongated metal cross-plate secured at opposite ends to the third and fourth plates, respectively, at locations intermediate ends of the third and fourth plates, the cross-plate extending generally parallel to the first and second plates and lying generally in a plane defined by the metal end frame, a metal reinforcing member secured to the cross-plate and projecting from one side thereof and generally out of the plane, the member being located intermediate the opposite ends of the cross-plate and inwardly of the third and fourth plates and at least a pair of metal supports connected to the metal end frame and extending generally perpendicular to the end frame along opposite sides of the metal end frame for securement to the container.

In a further preferred embodiment according to the present invention, there is provided a container for shipping nuclear fuel, comprising an elongated container body having sides, a top and bottom and opposite ends, a metal end frame for reinforcing each of the opposite ends of the container body, each metal end frame comprising first and second elongated metal plates generally parallel to and spaced from one another and third and fourth metal plates generally parallel to and spaced from one another, the third plate being secured at opposite ends to ends of the first and second plates and the fourth plate being secured at opposite ends to opposite ends of the first and second plates thereby forming the metal end frame in a generally rectilinear configuration, an elongated metal cross-plate secured at opposite ends to the third and fourth plates, respectively, and at locations intermediate ends of the third and fourth plates, the cross-plate extending generally parallel to the first and second plates and lying generally in a plane defined by the metal end frame, a metal reinforcing member secured to the cross-plate and projecting from one side thereof and generally out of the plane, the member being located intermediate the opposite ends of the cross-plate and inwardly of the third and fourth plates, at least a pair of supports connected to the metal end frame and extending generally perpendicular to the end frame along opposite sides of the metal end frame for securement to the container, the metal end frames being secured, preferably by a plurality of metal screws, to the container body ends, respectively, with the supports straddling opposite sides of the container body ends.

In a still further preferred embodiment according to the present invention, there is provided a container for shipping nuclear fuel, comprising an elongated container body having sides, a top and bottom and opposite ends, a metal end frame for overlying and reinforcing each of the opposite ends of the container body and lying in a plane, the ends and the sides of the container body being formed at least in part of wooden framing elements, a reinforcing member secured to the metal end frame and projecting from one side of the metal end frame and generally out of the plane, the member being located intermediate opposite edges of the metal end frame, at least a pair of metal supports connected to the metal end frame and extending generally perpendicular to the metal end frame along opposite sides of the metal end frame for securement to the container, each of the metal end frame and supports being secured to the wood framing elements along the ends and sides of the container body, respectively, with the supports straddling opposite sides of the container body ends, the reinforcing member engaging at least a portion of the container body to reinforce the container body.

DETAILED DESCRIPTION OF THE INVENTION

Figure 1:
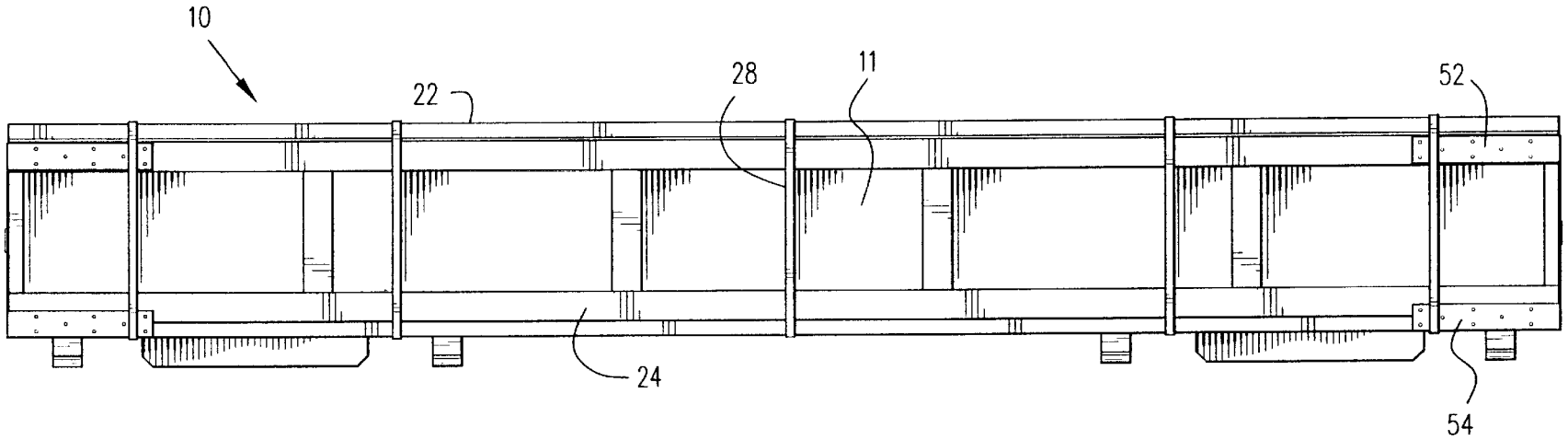
FIG. 1 is a side elevational view of a shipping container for nuclear fuel assemblies having end support systems constructed in accordance with a preferred embodiment of the present invention applied to opposite ends of the container.
Figure 2:
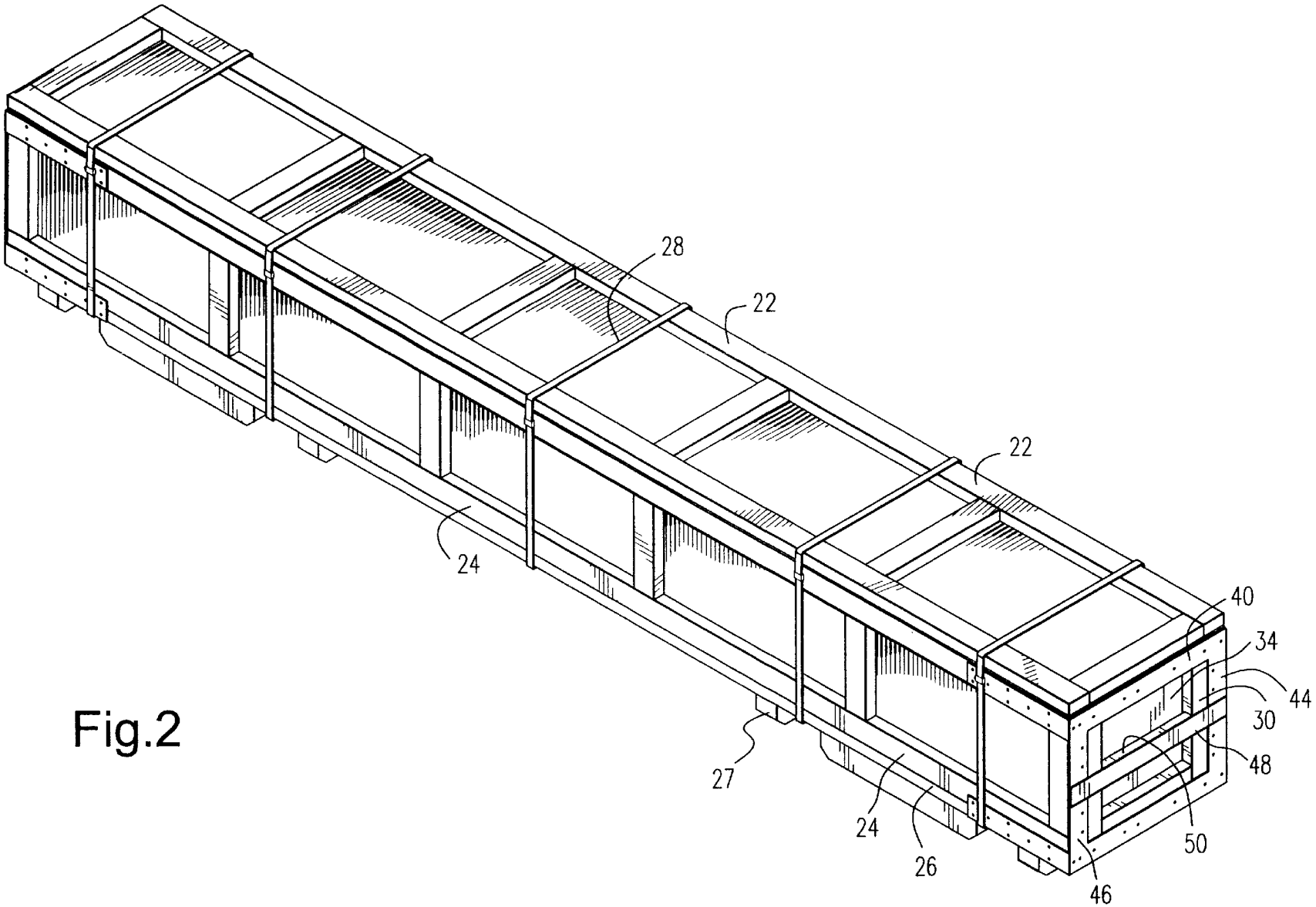
FIG. 2 is a perspective view thereof.
Figure 3:
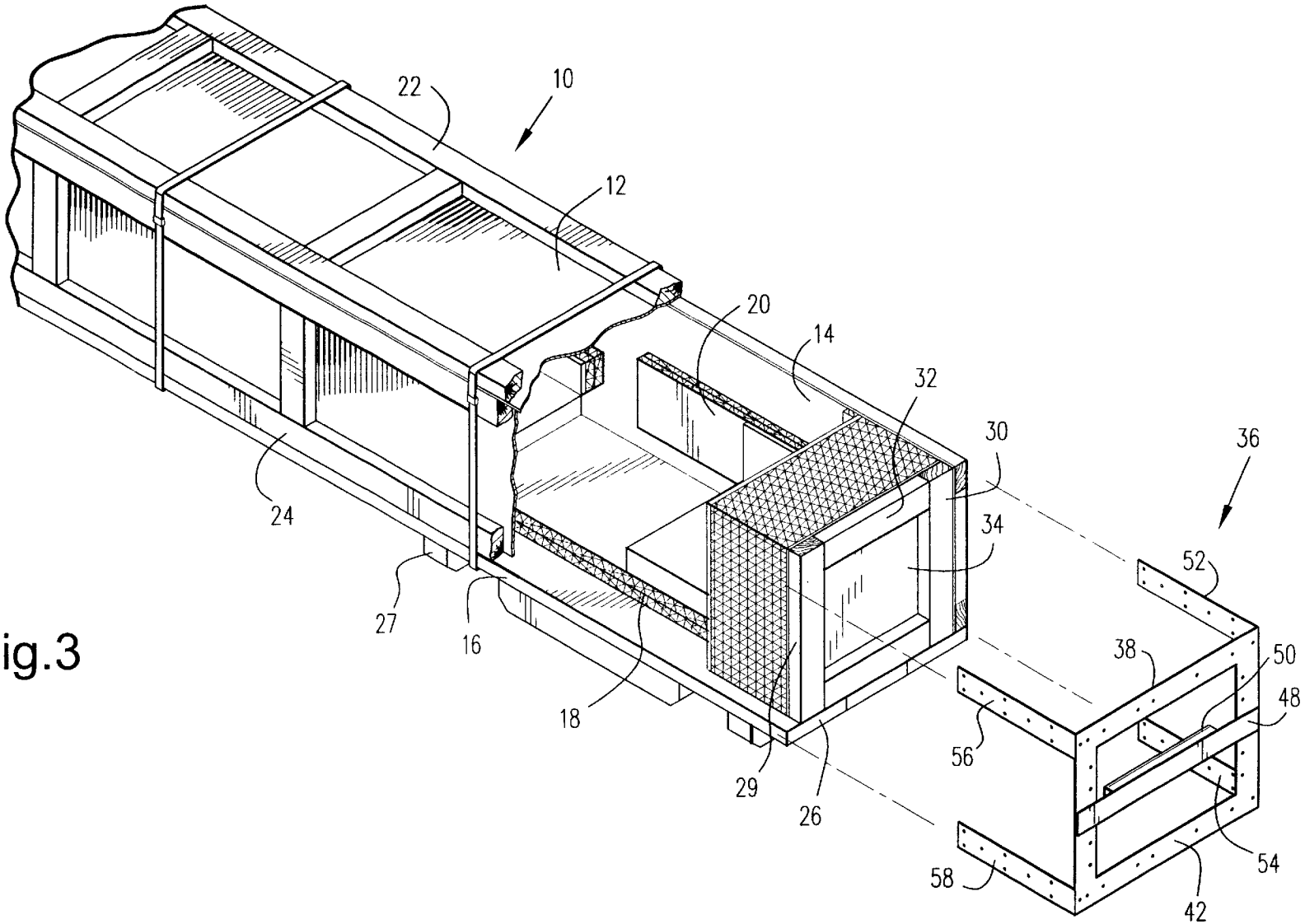
FIG. 3 is a view similar to FIG. 2 with portions broken out illustrating in part the interior of the wooden outer container and illustrating an end support system hereof broken out from the end of the container.

Referring now to the drawings, particularly of FIGS. 1 and 3, there is illustrated a container, generally designated 10, for shipping unclear fuel assemblies. Container 10 includes a container body 11 containing an interior metal box, not shown, in which a pair of fuel assemblies (also not shown), each including fuel rods and mechanical hardware, are disposed in side-by-side relation to one another. The inner metal box is confined within container 10. The top and sides of the container body 11 include panels 12 and 14, preferably formed of plywood, and a bottom 16 (FIG. 3). The top, bottom and sides are lined along the interior of container 10 by honeycomb structures 18 and foam pads 20 to confine the inner metal box within container 10. Container 10 also includes exterior structural wooden framing elements. For example, elongated wooden 2×4s 22 and 24 are provided along the top and sides, respectively, of the container. Wooden planks 26 preferably form the bottom 16 of the container. Skids 27 (FIGS. 2 and 3) are also located below the container bottom to facilitate lifting the container, e.g., by a forklift.

The ends of container 10 also include rectilinear end frames 29 (FIG. 3) formed of wooden framing elements. For example, each rectilinear end frame 29 is preferably formed of a pair of vertical wooden 2×4s 30 spaced from one another and a pair of horizontal 2×4s 32 forming the top and bottom framing elements of the wooden end frame. Additionally, a panel, for example, a plywood panel 34 is secured to the wooden end frame 29 along the inside end surface of the wooden elements 30 and 32. The construction of the container 10 as illustrated including the wooden framing elements, plywood panels, strapping, honeycomb and foam panels and wooden end frames is conventional except for the container end support system which will now be described.

Figure 4:
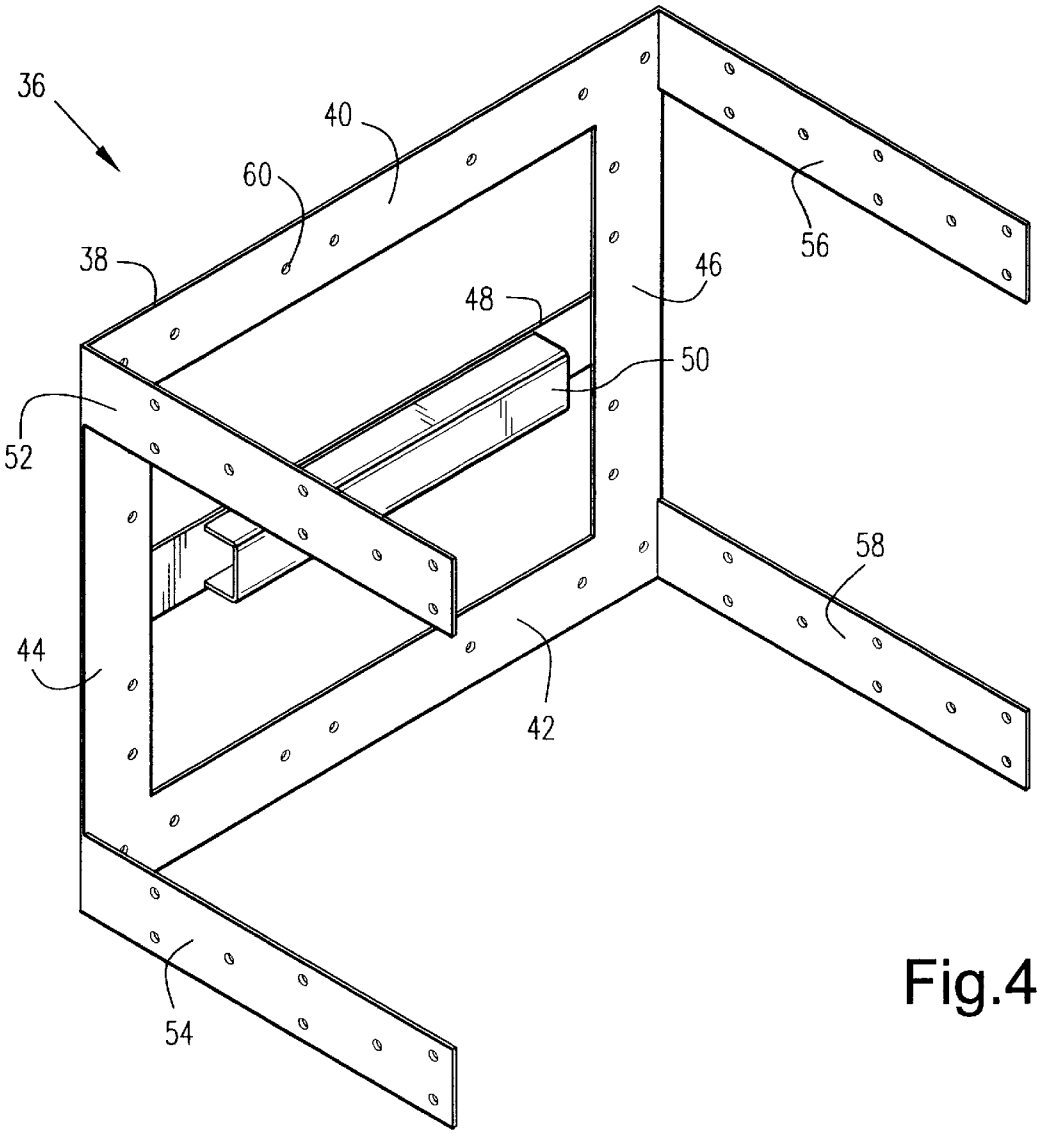
FIG. 4 is a perspective view of an end support system constructed in accordance with a preferred embodiment of the present invention.

An end support system, generally designated 36, is applied in accordance with the present invention to the opposite ends of the container 10 to reinforce the container ends and to ensure sufficient structural integrity to meet the required drop tests of the licensing regulations. Referring to FIGS. 3 and 4, each end support system 36 comprises a metal end member or frame 38 including first and second metal plates 40 and 42 extending generally parallel to and spaced from one another. Each metal end frame 38 also includes third and fourth metal plates 44 and 46 which are generally parallel to and spaced from one another. Plates 44 and 46 are secured at their opposite ends to the metal plates 40 and 42. For example, the third plate 44 may be welded at its ends to the ends of the first and second plates 40 and 42, respectively. The fourth plate 46 may be welded to the opposite ends of the first and second plates 40 and 42, respectively, forming a generally rectilinear end frame lying in a plane. As illustrated, the plates 40 and 42 are horizontal for extending along the top of the container at its end face, while plates 44 and 46 are vertical for extending along the opposite sides of the container 10 at its end face.

A metal crosspiece 48 also extends between the two side plates 44 and 46. The metal crosspiece 48 overlies the side plates 44 and 46 and is preferably welded thereto. A reinforcing member 50, preferably in the form of a channel, is secured along the inside face of crosspiece 48 and terminates short of the ends of crosspiece 46, for purposes described hereafter.

Metal supports extend in a generally perpendicular direction to said metal end frame for securing said metal end frame to said container end. At least two supports extend along opposite sides of container 10 for this purpose and, preferably, each such support comprises a pair of support arms. For example, four support arms 52, 54, 56 and 58 extend from the corners of the metal end frame 36 in a direction generally perpendicular to the plane of the end support frame. The arms comprise metal plates for extending along the sides of the container 10 in overlying relation to the wooden framing elements forming the sides of container 10. The arms lie in planes parallel to the container sides. As illustrated in FIG. 4, the metal plates 40, 42, 44 and 46 and arms 52, 54, 56 and 58 have a plurality of preformed holes, for example, holes 60, for receiving screws to screw the end support system 36 to the wooden end frames 24, 26, 29, 30 and 32 of the wooden container 10 as illustrated in FIG. 3.

To apply an end support system 36 to an end of the container 10, the system 36 is disposed on the container end with the plates 40 and 42 overlying the wooden top and bottom framing elements 32 and plates 44 and 46 overlying the wooden side framing elements 30. The arms 52, 54, 56 and 58 extend along opposite sides of the container overlying portions of the elongated wooden framing elements 16 and 24. Note (in FIG. 2) that the upper edge of the end support assembly 36, i.e., the metal plate 40, lies below the cover for the outer container 10. Additionally, it will be appreciated that the arms 52, 54, 56 and 58 straddle the sides of container 10.

With the end support assembly 36 applied to the end of the container, a series of screws are passed through the openings 60 of the metal end support 36 to secure it to the container end. The screws are preferably flathead 8×80 mm screws with ribs under the screw head. It will be appreciated that the screw openings 60, as illustrated in FIG. 4, along arms 52, 54, 56 and 58, are formed in an alternating pattern of a pair of openings followed by a single opening along the lengths of the arms. This minimizes any tendency to split the wooden framing elements and affords a securement to the wood.

Upon review of FIG. 2, it will be appreciated that, in final securement, the reinforcing member 50, i.e., the channel, is disposed between the wooden side framing elements 30 with its opposite ends butting against the inside edges of framing elements 30 to reinforce elements 30. Additionally, the channel has a depth, in the longitudinally direction of the container, the bear against the end panel 34. The channel thus affords reinforcement to both the side wooden framing elements 30 and to the panel 34. Because of the structural relationship of the plates, crosspeice and arms and the plurality of metal screws used to secure the plates and arms of the metal end frame to the end of the container, structural integrity of the end of the container is maintained and assured within the requirements of the drop tests mandated by nuclear regulatory licensing requirements. As illustrated, container 10 not only has the end support assemblies at opposite ends but is banded, e.g., by bands 28, at longitudinally spaced intervals which also assists in maintaining the integrity of the outer container.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An end support system for a container for shipping nuclear fuel, comprising:

first and second elongated metal plates generally parallel to and spaced from one another and third and fourth metal plates generally parallel to and spaced from one another, said third plate being secured at opposite ends to ends of said first and second plates and said fourth plate being secured at opposite ends to opposite ends of said first and second plates thereby forming a generally rectilinear metal end frame;

an elongated metal cross-plate secured at opposite ends to said third and fourth plates, respectively, at locations intermediate ends of said third and fourth plates, said cross-plate extending generally parallel to said first and second plates and lying generally in a plane defined by said metal end frame;

a metal reinforcing member secured to said cross-plate and projecting from one side thereof and generally out of said plane, said member being located intermediate said opposite ends of said cross-plate and inwardly of said third and fourth plates; and at least a pair of metal supports connected to said metal end frame and extending generally perpendicular to said end frame along opposite sides of said metal end frame for securement to the sides of said container.

2. A system according to claim 1 wherein said reinforcing member and said supports project in the same direction from the plane of said metal end frame.

3. A system according to claim 1 wherein said reinforcing member is elongated and extends along a central region of said crosspiece, terminating at opposite ends short of the ends of said crosspiece.

4. A system according to claim 3 wherein said reinforcing member comprises a channel.

5. A system according to claim 1 wherein said metal supports comprise a pair thereof secured to each of opposite sides of said metal end frame.

6. A system according to claim 1 wherein said metal supports comprise four arms secured to said end frame adjacent corners thereof.

7. A container for shipping nuclear fuel, comprising:

an elongated container body having sides, a top and bottom and opposite ends, a discrete metal and frame for reinforcing each of said opposite ends of said container body, each said metal end frame comprising first and second elongated metal plates generally parallel to and spaced from one another and third and fourth metal plates generally parallel to and spaced from one another, said third plate being secured at opposite ends to ends of said first and second plates and said fourth plate being secured at opposite ends to opposite ends of said first and second plates thereby forming said metal end frame in a generally rectilinear configuration;

an elongated metal cross-plate secured at opposite ends to said third and fourth plates, respectively, and at locations intermediate ends of said third and fourth plates, said cross-plate extending generally parallel to said first and second plates and lying generally in a plane defined by said metal end frame;

a metal reinforcing member secured to said cross-plate and projecting from one side thereof and generally out of said plane, said member being located intermediate said opposite ends of said cross-plate and inwardly of said third and fourth plates;

at least a pair of supports connected to said metal end frame and extending generally perpendicular to said end frame along opposite sides of said metal end frame for securement to said container;

said metal end frames being secured to said container body ends respectively, with said supports straddling opposite sides of said container body ends.

8. A container according to claim 7 wherein said ends and said sides of said container body are formed at least in part of wooden framing elements, each said metal end frame and said supports thereof being secured to said wooden framing elements along said ends and said sides, respectively, of said container body.

9. A container according to claim 7 wherein each said container body end includes wooden framing elements underlying said metal plates, respectively, and in a plane parallel to said plane of said end frames, said reinforcing member extending between a pair of said wooden frame elements.

10. A container according to claim 7 wherein each said container body end includes wooden end framing elements forming a wooden end frame underlying said metal end plates, respectively, and in a plane parallel to said plane of said metal end frame, an end panel on each said container body end secured to a side of said wooden end framing elements opposite said metal end frame, said reinforcing member projecting from the plane of said metal end frame to reinforce said end panel.

11. A container according to claim 10 wherein said reinforcing member extends between a pair of said wooden frame elements of said wooden end frame and comprises a channel.

12. A container according to claim 7 wherein said metal supports comprise four arms secured to said end frame adjacent corners thereof.

13. A container for shipping nuclear fuel, comprising:

an elongated container body having sides, a top and bottom and opposite ends;

a metal end frame for overlying and reinforcing each of said opposite ends of said container body and lying in a plane, said ends and said sides of said container body being formed at least in part of wooden framing elements;

a reinforcing member secured to said metal end frame and projecting from one side of said metal end frame and generally out of said plane, said member being located intermediate opposite edges of said metal end frame;

at least a pair of metal supports connected to said metal end frame and extending generally perpendicular to said metal end frame along opposite sides of said metal end frame for securement to said container;

each said metal end frame and said supports being secured to said wood framing elements along said ends and sides of said container body, respectively, with said supports straddling opposite sides of said container body ends, said reinforcing member engaging at least a portion of said container body to reinforce the container body.

14. A container according to claim 13 wherein said metal end of frames are discrete and spaced from one another at said opposite ends of said container body, said container body including wooden end framing elements forming wooden end frames underlying said metal end plates, respectively, said wooden end frames lying in planes parallel to planes containing said metal end frames, an end panel on each said container body end secured to a side of said wooden end framing elements opposite said metal end frame, said reinforcing member projecting form the plane of said metal end frame to reinforce said end panel.

15. A container according to claim 14 wherein said reinforcing member extends between a pair of said wooden end frame elements and comprises a channel.

16. A container according to claim 15 wherein said metal supports comprise four arms secured to said end frame adjacent corners thereof.

* * * * *

UNITED STATES PATENT AND TRADEMARK OFFICE

CERTIFICATE OF CORRECTION

PATENT NO. : 6,603,133 B2
DATED : August 5, 2003
INVENTOR(S) : Peters et al.

It is certified that error appears in the above-identified patent and that said Letters Patent is hereby corrected as shown below:

Column 3,
Line 46, delete “of FIGS.” and insert -- to FIGS. -- therefor.
Line 48, delete “unclear” and insert -- nuclear -- therefor.

Column 5,
Line 18, delete “longitudinally” and insert -- longitudinal -- therefor.
Line 19, delete “the bear” and insert -- to bear -- therefor.
Line 21, insert -- end -- before “panel 34.”.

Column 6,
Line 14, delete “metal and frame” and insert -- metal end frame -- therefor.

Column 8,
Line 14, delete “projecting form” and insert -- projecting from -- therefore.

Signed and Sealed this

Twenty-eighth Day of October, 2003

JAMES E. ROGAN
*Director of the United States Patent and Trademark Office*